US006641431B2

(12) United States Patent
Saitoh

(10) Patent No.: US 6,641,431 B2
(45) Date of Patent: Nov. 4, 2003

(54) CONNECTOR FOR FLAT CABLES

(75) Inventor: Yasushi Saitoh, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/012,516

(22) Filed: Dec. 12, 2001

(65) Prior Publication Data

US 2002/0076976 A1 Jun. 20, 2002

(30) Foreign Application Priority Data

Dec. 14, 2000 (JP) ..... 2000-380456

(51) Int. Cl.[7] ..... H01R 9/07
(52) U.S. Cl. ..... 439/495; 439/496; 439/857
(58) Field of Search ..... 439/495, 496, 439/856, 857, 492

(56) References Cited

U.S. PATENT DOCUMENTS

| | | | | |
|---|---|---|---|---|
| 5,897,394 A | * | 4/1999 | Adachi | 439/496 |
| 6,234,822 B1 | | 5/2001 | Gallin et al. | |
| 6,238,238 B1 | * | 5/2001 | Hwang et al. | 439/495 |
| 6,254,440 B1 | * | 7/2001 | Ko et al. | 439/857 |

* cited by examiner

*Primary Examiner*—Alexander Gilman
(74) *Attorney, Agent, or Firm*—Oliff & Berridge, PLC

(57) ABSTRACT

A connector 20 comprises a support portion 22*a* supported by a housing 21, and connection end portions 22*b* and 22*c* extending from the support portion 22*a* in a bifurcated manner, wherein a conductor 3 of a flat cable 1 is held between the connection end portions 22*b* and 22*c* to electrically connect to the terminal and a projection portion 22*d*, which can bite into the conductor 3, is formed on at least one of the connection end portions 22*b* and 22*c*.

11 Claims, 5 Drawing Sheets

CONNECTOR FOR FLAT CABLES

BACKGROUND OF THE INVENTION

1. Field of the Invention

This invention relates to a connector used in an OA device, a home electrical appliance, the internal wiring of an automobile or the like.

SUMMARY OF THE INVENTION

An object of the invention is to provide a connector in which a contact position of this connector with respect to a flat cable can be maintained.

According to a first aspect of the invention, there is provided a connector comprising: a support portion supported by a housing; connection end portions extending from the support portion in a bifurcated manner; and a projection portion disposed at least one of the connection end portions, wherein the connection end portions hold a flat cable to electrically connect to a conductor of the flat cable.

In the above construction, the projection portion, which can bite into the conductor of the flat cable, is formed on at least one of the connection end portions, and therefore the displacement of the contact position due to the deterioration of the connector, developing during the use thereof, is suppressed. Namely, even when the temperature gradient is large, and the connection end portions and the conductor are made of materials of different thermal expansion coefficients, respectively, the projection portion bites into the conductor of the flat cable, so that the point of contact between the connection portion and the conductor will not be displaced out of position, and therefore the press-contact position is maintained at the predetermined position.

For example, the narrow-angle of that side of the projection portion, opposed to the conductor of the flat cable, may be smaller than 150°, according to a second aspect of the invention, or the projection portion may have a curved shape portion formed on that side thereof opposed to the conductor of the flat cable, the curvature radius of the curved shape portion being smaller than 0.4 mm, according to a third aspect of the invention.

BRIEF DESCRIPTION OF THE DRAWINGS

FIG. 1 shows the overall construction of a connector according to one embodiment of the present invention and a manner of fitting an end portion of a flat cable into this connector.

FIG. 5 is a side cross-sectional view showing a construction of one example of a connector according to the invention and FIG. 5A shows a condition immediately before fitting of a flat cable is started and FIG. 5B shows a condition in which the flat cable is fitted.

DETAILED DESCRIPTION OF THE PREFERRED EMBODIMENTS

Figure 2:
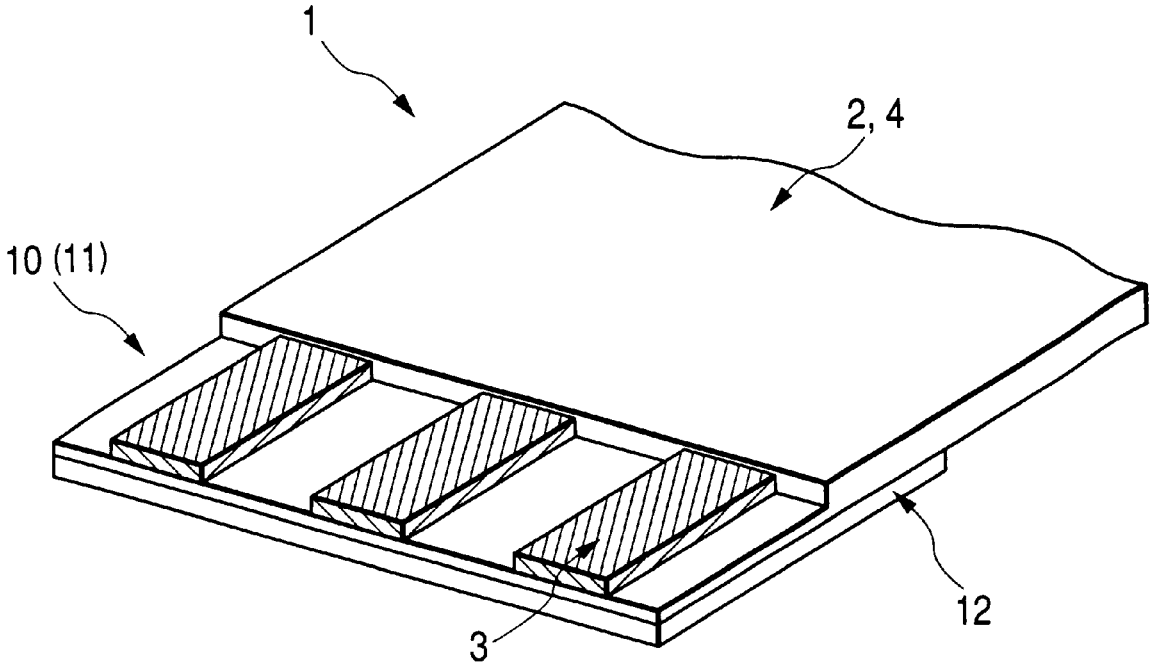
FIG. 2 is a perspective view of an end structure of the flat cable to which the connector according to this embodiment is applied.

FIG. 2 is a perspective view of an end structure of a flat cable to which a connector according to one embodiment of the present invention is applied.

As shown in FIG. 2, a flat cable 1 according to this embodiment is used in an OA device, a home electrical appliance, the internal wiring of an automobile or the like. Conductors 3, 3, . . . having a approximately rectangular cross-section is laid on a base film 2 to form a plurality of elongate conductor patterns and then a cover lay film 4 is affixed onto these conductor patterns, thereby forming the flat cable 1. Although the number of the conductors 3 shown in FIG. 2 is only three for the sake of description, about 50 conductors 3, 3, . . . are actually provided at a pitch of 0.5 to 1.25 mm.

An end portion 10 of the flat cable 1 has a conductor-exposed portion 11 so that it can be electrically connected to the connector 20 described later and a reinforcing sheet 12 is affixed to a reverse side of this end portion for reinforcing this conductor-exposed portion 11. Namely, the cover lay film 4 is removed from the conductor-exposed portion 11 and distal end portions of the conductors 3, 3, . . . are exposed by a predetermined length. The conductors 3, 3, . . . are made, for example, of copper or a copper alloy.

Figures 1A, 1B, 1C:
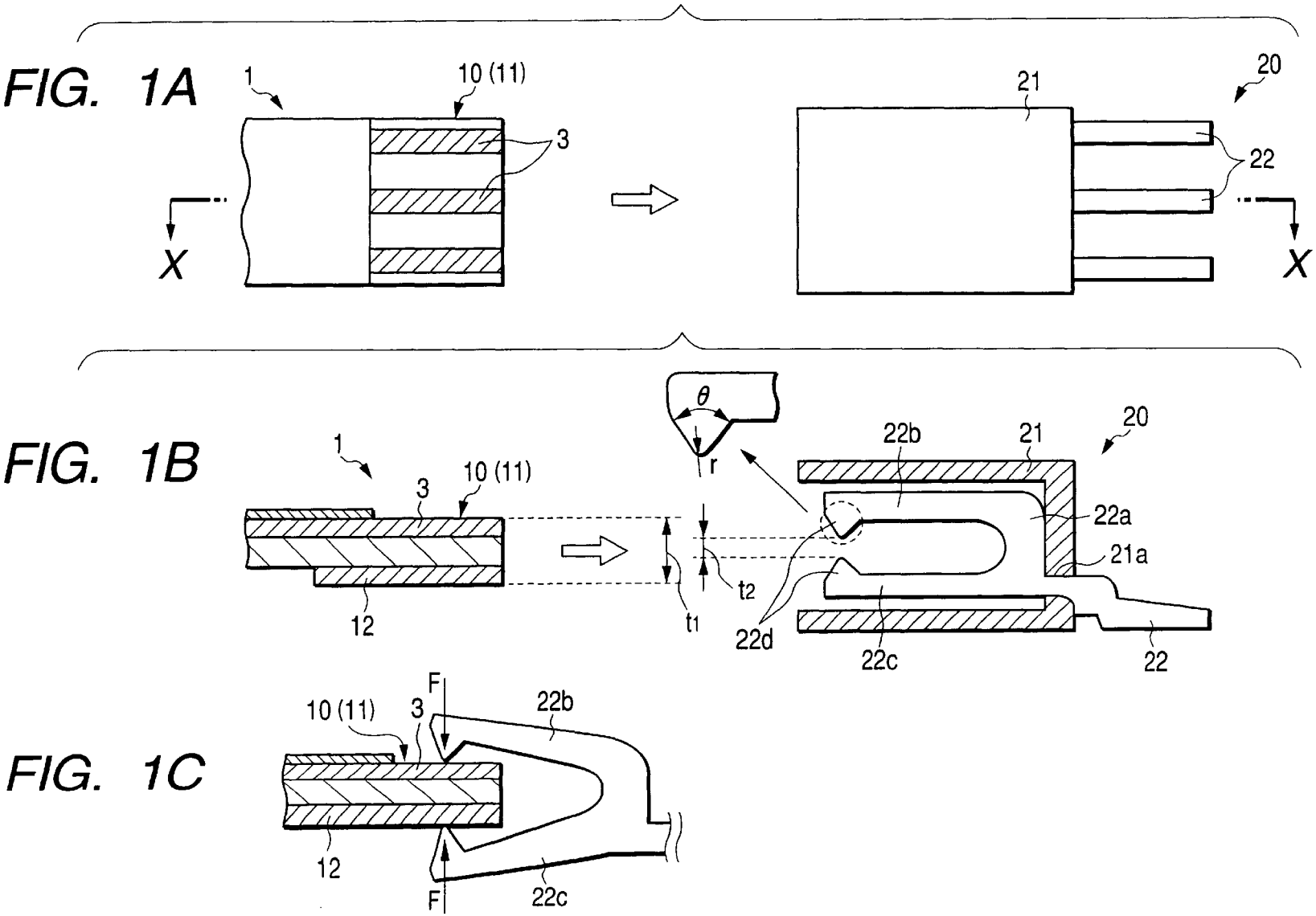
FIG. 1A is a plan view showing a condition before the fitting.
FIG. 1B is a cross-sectional view taken along a line X—X of FIG. 1A.
FIG. 1C is a fragmentary cross-sectional view showing a state during fitting in FIG. 1B.

FIG. 1 shows the overall construction of the connector, and a manner of fitting the end portion of the flat cable into this connector and FIG. 1A is a plan view showing a condition before the fitting, FIG. 1B is a cross-sectional view taken along the line X—X of FIG. 1A, and FIG. 1C is a fragmentary cross-sectional view showing a state during fitting in FIG. 1B.

As shown in FIG. 1A, the connector 20 includes terminals corresponding in number to the conductors 3, 3, . . . of the flat cable 1. With respect to its configuration, fork-like terminals 22, 22, . . . , corresponding to the conductors 3, 3, . . . respectively, are provided in a housing 21 of a U-shaped cross-section having an open side through which the conductors 3, 3, . . . are inserted, as shown in FIG. 1B.

A support portion 22*a* of each fork-like terminal 22 is fitted in a predetermined insertion hole 21*a* formed in the housing 21, thereby being fixed thereto. Connection end portions 22*b* and 22*c* extend from this support portion 22*a* in a bifurcated manner and have projection portions 22*d*, respectively, which are directed inwardly toward each other. These connection end portions 22*b* and 22*c* can be resiliently opened and closed so as to releasably hold the conductor 3.

When the conductor 3 is inserted into the fork-like terminal 22, the connection end portions 22*b* and 22*c* of the fork-like terminal 22 are opened as shown in FIG. 1C, and contact pressures F and F produced by reaction forces of the connection end portions 22*b* and 22*c* of the fork-like terminal 22, respectively, act on the conductor 3, thereby holding the conductor 3.

Figure 3:
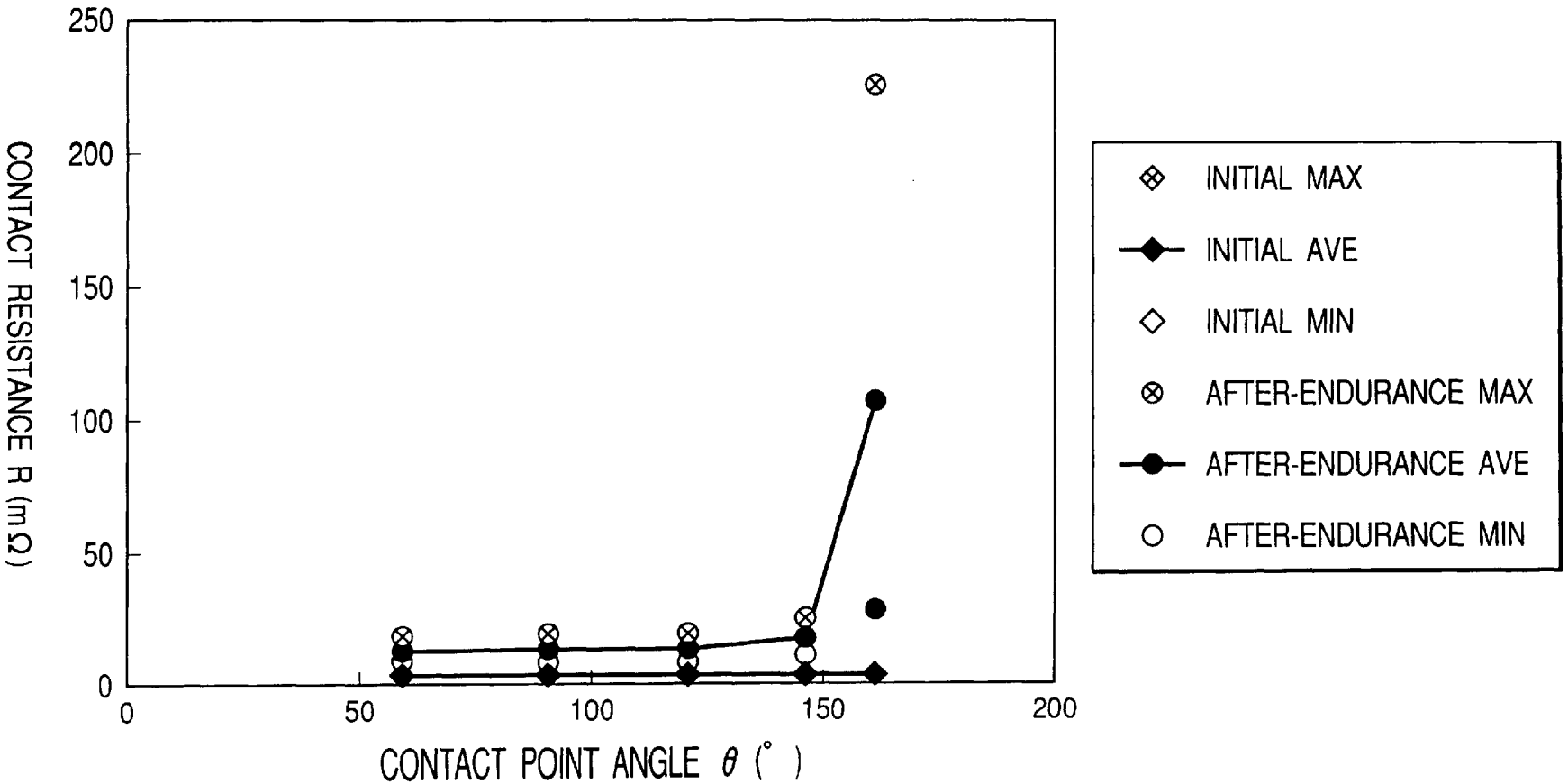
FIG. 3 is a diagram showing a relation between a contact point angle of the connector and a contact resistance thereof as a graph.

Here, a limitation is imposed on a narrow-angle (contact point angle) θ of a side of the projection portion 22*d* to be opposed to the conductor 3, and its angle is determined by measuring a contact resistance R corresponding to a displacement amount produced when the conductor 3 is fitted to the connection end portion 22*b* of the fork-like terminal 22. Results of this measurement are shown in FIG. 3. The reason why the contact resistance R corresponding only to the amount of displacement of the connection end portion 22*b* is measured is that an effect of biting (described later)

of the projection portion 22*d* into the conductor 3 can not be measured since the hardness of the reinforcing sheet 12 affixed to the reverse side of the end portion 10 is very much lower than the hardness of the conductor 3. Actually, the amount of displacement between the connection end portions 22*c* and 22*d* obtained when the conductor 3 is fitted is a value obtained by subtracting the distance t2 between the connection end portions 22*c* and 22*d* at their contact points from the thickness t1 of the end portion 10 and the contact resistance R at this time corresponds to the contact pressure F between the projection portion 22*d* and the conductor 3 at the contact point.

In FIG. 3, the abscissa axis represents the contact point angle θ (°) and the ordinate axis represents the contact resistance R (mΩ). In this Figure, at an initial period corresponding to the time when the connector 20 begins to be used, the maximum value (MAX), average value (AVE) and minimum value (MIN) of the contact resistance R are all kept to almost zero regardless of the contact point angle θ (The indication in the Figure is represented by the average value). On the other hand, after the endurance, that is, a predetermined period of time after the connector 20 is used, the maximum value (MAX), average value (AVE) and minimum value (MIN) of the contact resistance R all increase gradually with the increase of the contact point angle θ before this angle reaches 150°, but these values all increase abruptly when the contact point angle θ exceeds 150°.

The reason why the abrupt change thus occurs at the contact point angle θ of 150° is that when the contact point angle θ is smaller than this angle (150°), the projection portion 22*d* bites into the conductor 3 to be hardly moved by a fine sliding movement due to external factors such as a temperature change and vibrations, but when the angle E exceeds this angle value (150°), it is difficult for the projection portion 22*d* to bite into the conductor 3 so that the projection portion 22*d* is easily moved by the external factors. Therefore, it is found that the contact point angle θ is preferably not larger than 150°.

In a case where the projection portion 22*d* is formed by blanking with a die, this projection portion always has a curved shape portion at a side thereof to be opposed to the conductor 3, and the curvature radius r of this curved shape portion is determined by measuring the contact resistance R' corresponding to the above displacement amount produced when the conductor 3 is fitted to the connection end portion 22*b* of the fork-like terminal 22. Results of this measurement are shown in FIG. 4.

Figure 4:
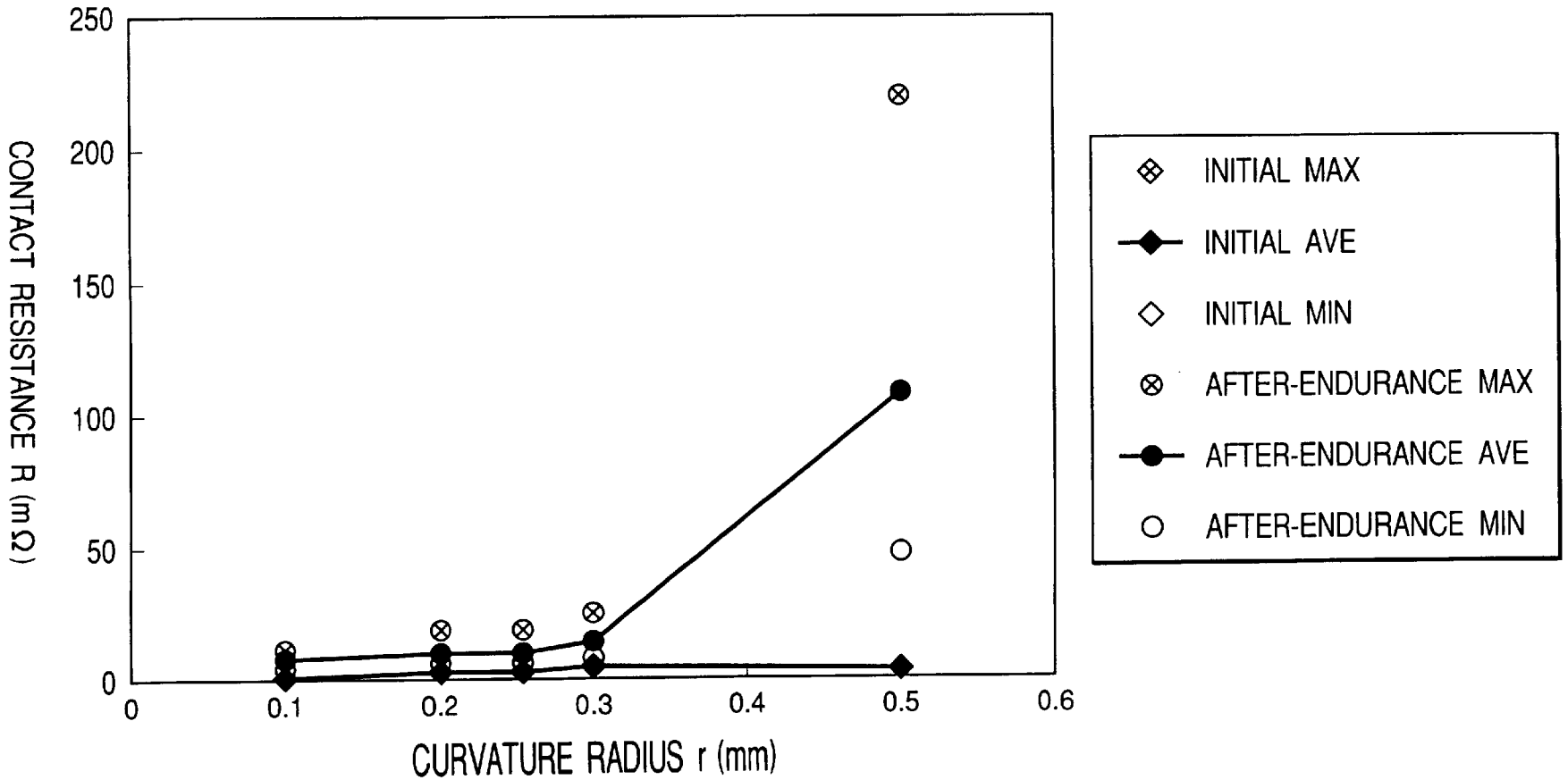
FIG. 4 is a diagram showing a relation between a radius of a curved shape portion of the connector at the contact point and the contact resistance as a graph.

In FIG. 4, the abscissa axis represents the curvature radius r (mm) of the curved shape portion at the contact point and the ordinate axis represents the contact resistance R' (mΩ). In this Figure, at an initial period corresponding to a time when the connector 20 begins to be used, the maximum value (MAX), average value (AVE) and minimum value (MIN) of the contact resistance R' are all kept to almost zero regardless of the curvature radius r of the curved shape portion (The indication in the Figure is represented by the average value). On the other hand, after the endurance, that is, after the connector 20 is used during a predetermined period of time, the maximum value (MAX), average value (AVE) and minimum value (MIN) of the contact resistance R' all increase gradually with the increase of the curvature radius r of the curved shape portion before this curvature radius reaches 0.3 mm, but these values all increase abruptly when the curvature radius r of the curved shape portion exceeds 0.3 mm.

The reason why the abrupt change thus occurs when the curvature radius r of the curved shape portion exceeds 0.3 mm is that when the curvature radius r is smaller than this value (0.3 mm), the projection portion 22*d* bites into the conductor 3 so that it is difficult for this projection portion to be moved by a fine sliding movement due to external factors such as a temperature change and vibrations, but when the curvature radius exceeds this value (0.3 mm), the projection portion 22*d* is difficult to bite into the conductor 3 to be moved by the external factors. On the other hand, in view of an error involved in the manufacture by using the die, and so on, it is further preferable that the curvature radius r of the curved shape portion is not smaller than 0.2 mm. Therefore, it is most suitable that the curvature radius r of the curved shape portion is not smaller than 0.2 mm and is smaller than 0.4 mm.

As described above, according to the connector 20 of this embodiment, the projection portion 22*d*, which can bite into the conductor 3 of the flat cable 1, is provided on at least one of the connection end portions 22*b* and 22*c*, and therefore even when the connector is used in an environment in which a large temperature gradient develops during the use, and the fork-like terminals 22, 22, . . . and the conductors 3, 3, . . . are made of materials having different thermal expansion coefficients, respectively, the projection portion 22*d* bites into the conductor 3 so that the point of contact between each of the connection end portions 22*c*, 22*d* and the conductor 3 will not be displaced out of position, and therefore the press-contact position thereof is maintained substantially at the predetermined position. As a result, the durability of the connector 20 can be greatly enhanced.

Figures 5A, 5B:
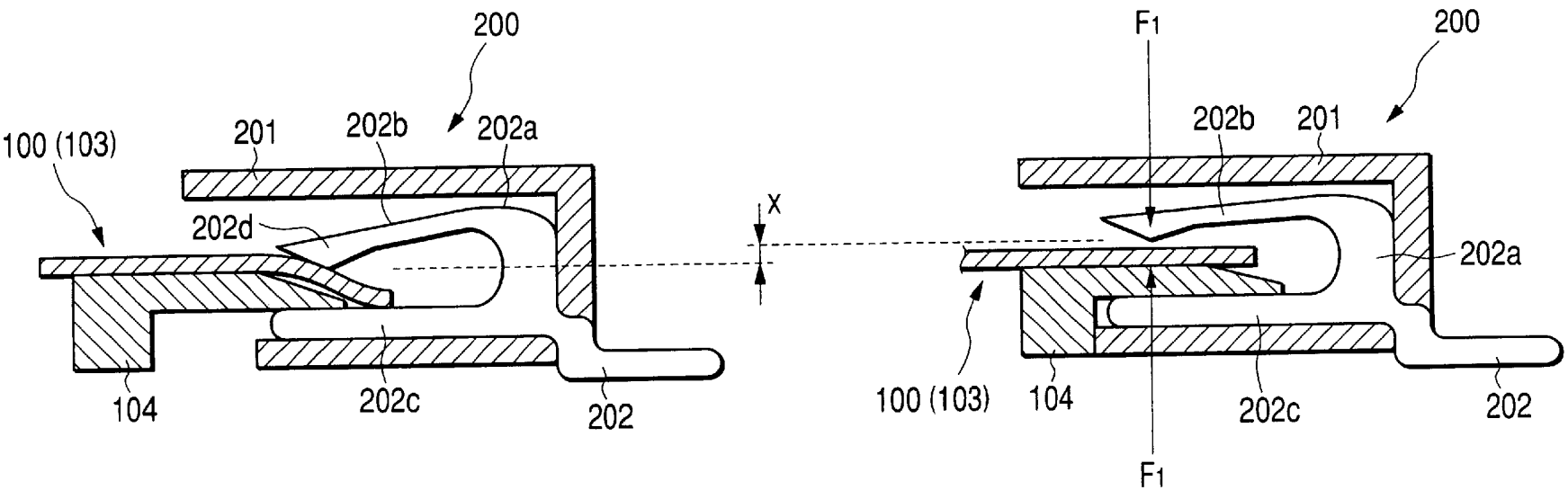

In the above embodiment, although the two connection end portions 22*b* and 22*c* of each of the fork-like terminals 22, 22, . . . of the connector 20 both have the projection portions 22*d*, respectively, the projection portion maybe formed on only one of the two, and the other connection end portion may have a straight configuration. Even in this case, the configuration of the projection portion 22*d* is determined only on a basis of the amount of displacement of the connection end portion 22*b*, and therefore when the projection portion 22*d* is formed into the above-mentioned configuration, this is sufficient. Further, this structure may be applied to the connector of FIG. 5 which is constructed in combination with the slider. In this case, the condition in relation to the projection portion is applied to the portion 202*d* in FIG. 5.

In the above embodiment, the narrow-angle (contact point angle) θ of that side of the projection portion 22*d*, which is to be opposed to the conductor 3, is smaller than 150°, and the curvature radius r of the curved shape portion is smaller than 0.4 mm. However, if at least one of the conditions in relation to the narrow-angle and the curvature radius is met, the effect of the invention can realize.

In the above embodiment, although the reinforcing sheet 12 is affixed to the reverse side of the end portion 10 of the flat cable 1, the end portion 10 may be supported by a wedge-shaped slider instead of using this reinforcing sheet.

According to a first aspect of the invention, even when the temperature gradient is large in a deteriorated condition of the connector developing during the use thereof, and the connection end portions and the conductors are made of materials of different thermal expansion coefficients, respectively, the projection portion bites into the conductor of the flat cable so that the point of contact between the connection end portion and the conductor will not be displaced out of position, and therefore the press-contact position thereof is maintained substantially at the predetermined position. As a result, the durability of the connector can be greatly enhanced.

What is claimed is:

1. A connector comprising:

a support portion supported by a housing;

connection end portions extending from the support portion in a bifurcated manner; and only one of the connection end portions having a projection portion disposed thereon, wherein the connection end portions hold a flat cable to electrically connect to a conductor of the flat cable;

the projection portion has a narrow-angle at a side thereof opposed to the conductor of the flat cable; and the narrow-angle is equal to or smaller than 150°.

2. A connector comprising:

a support portion supported by a housing;

connection end portions extending from the support portion in a bifurcated manner; and only one of the connection end portions having a projection portion disposed thereon, wherein the connection end portions hold a flat cable to electrically connect to a conductor of the flat cable;

the projection portion has a curved shape portion at a side thereof opposed to the conductor of the flat cable; and the curvature radius of the curved shape portion is smaller than 0.4 mm.

3. The connector according to claim 3, wherein the curvature radius of the curved shape portion is equal to or larger than 0.2 mm.

4. A connector comprising:

a support portion supported by a housing;

first and second connection end portions extending from the support portion in a bifurcated manner; and at least one of the first and second connection end portions having a projection portion disposed thereon, wherein the connection end portions hold a flat cable, between first sides of the connection end portions, to electrically connect to a conductor of the flat cable;

a second side of one of the first and second connection end portions, opposite the first side, abuts the housing prior to insertion of the flat cable between the first and second connection end portions;

the projection portion has a narrow-angle at a side thereof opposed to the conductor of the flat cable; and the narrow-angle is equal to or smaller than 150°.

5. A connector comprising:

a support portion supported by a housing;

first and second connection end portions extending from the support portion in a bifurcated manner; and at least one of the first and second connection end portions having a projection portion disposed thereon, wherein the connection end portions hold a flat cable, between first sides of the connection end portions, to electrically connect to a conductor of the flat cable;

a second side of one of the first and second connection end portions, opposite the first side, abuts the housing prior to insertion of the flat cable between the first and second connection end portions;

the projection portion has a curved shape portion at a side thereof opposed to the conductor of the flat cable; and the curvature radius of the curved shape portion is smaller than 0.4 mm.

6. The connector according to claim 5, wherein the curvature radius of the curved shape portion is equal to or larger than 0.2 mm.

7. A connector comprising:

a support portion supported by a housing;

first and second connection end portions extending from the support portion in a bifurcated manner; and at least one of the first and second connection end portions having a projection portion disposed thereon, wherein the connection end portions hold a flat cable to electrically connect to a conductor of the flat cable, only one of the first and second connection end portions deflects when the flat cable is inserted between the first and second connection end portions;

the projection portion has a narrow-angle at a side thereof opposed to the conductor of the flat cable; and the narrow-angle is equal to or smaller than 150°.

8. A connector comprising:

a support portion supported by a housing;

first and second connection end portions extending from the support portion in a bifurcated manner; and at least one of the first and second connection end portions having a projection portion disposed thereon, wherein the connection end portions hold a flat cable to electrically connect to a conductor of the flat cable, only one of the first and second connection end portions deflects when the flat cable is inserted between the first and second connection end portions;

the projection portion has a curved shape portion at a side thereof opposed to the conductor of the flat cable; and the curvature radius of the curve shape portion is smaller than 0.4 mm.

9. The connector according to claim 8, wherein the curvature radius of the curved shape portion is equal to or larger than 0.2 mm.

10. A connector comprising:

a support portion supported by a housing;

connection end portions extending from the support portion in a bifurcated manner; and at least one of the connection end portions having a projection portion disposed thereon, wherein the connection end portions hold a flat cable to electrically connect to a conductor of the flat cable; the projection portion has a narrow-angle at a side thereof opposed to the conductor of the flat cable; and the narrow-angle is equal to or smaller than 150°.

11. A connector comprising:

a support portion supported by a housing;

connection end portions extending from the support portion in a bifurcated manner; and at least one of the connection end portions having a projection portion disposed thereon, wherein the connection end portions hold a flat cable to electrically connect to a conductor of the flat cable; the projection portion has a curved shape portion at a side thereof opposed to the conductor of the flat cable; and the curvature radius of the curved shape portion is smaller than 0.4 mm.

* * * * *